US005671624A

United States Patent [19]

Sivils

[11] Patent Number: 5,671,624

[45] Date of Patent: Sep. 30, 1997

[54] IGNITION KEY EXTENSION

[76] Inventor: Homer C. Sivils, 1930 Constitution Ave., Navarre, Fla. 32566

[21] Appl. No.: 640,177

[22] Filed: Apr. 30, 1996

[51] Int. Cl.[6] ..... E05B 19/04

[52] U.S. Cl. ..... 70/408; 16/110 R; 70/252; 70/395; 74/528; 74/557; 200/331; D8/343

[58] Field of Search ..... 70/408, 395, 397, 70/398, 252, 456 R, 375; 74/528, 557; 200/331; 180/316, 320; 16/110 R; 81/177.2; D8/343, 346

[56] References Cited

U.S. PATENT DOCUMENTS

| | | | |
|---|---|---|---|
| 1,646,528 | 10/1927 | Fairchild | 70/252 |
| 3,729,965 | 5/1973 | Gartner | 70/395 |
| 3,874,204 | 4/1975 | Capri | 70/427 |
| 3,882,702 | 5/1975 | Wiczer | 70/408 X |
| 4,036,040 | 7/1977 | Graizzaffi | 70/431 |
| 4,292,995 | 10/1981 | Mazzola | 70/408 X |
| 4,324,308 | 4/1982 | Clendenen | 70/254 X |
| 4,426,859 | 1/1984 | Floyd | 70/18 |
| 4,516,000 | 5/1985 | Ryberg et al. | 70/408 X |
| 4,583,383 | 4/1986 | Bosco et al. | 70/458 X |
| 4,821,542 | 4/1989 | Rosenthal | 70/454 |
| 4,910,983 | 3/1990 | Taylor | 70/456 R |
| 5,058,465 | 10/1991 | Womack | 70/408 X |
| 5,207,082 | 5/1993 | LeMaitre | 70/408 |
| 5,440,910 | 8/1995 | Florian | 70/408 X |
| 5,487,291 | 1/1996 | Voigt | 70/408 X |
| 5,600,980 | 2/1997 | Fabian | 70/408 |

*Primary Examiner*—Lloyd A. Gall
*Attorney, Agent, or Firm*—Patent & Trademark Services; Thomas Zack; Joseph H. McGlynn

[57] ABSTRACT

A plastic key extension cover having an extending handle. The cover is mounted on the key to be turned either by a friction fit or by inserting a member through the key's ring hole and a complementary cover hole. When the handle is pulled towards a user, the in-place key turns in its keyhole.

2 Claims, 1 Drawing Sheet

IGNITION KEY EXTENSION

BACKGROUND OF THE INVENTION

The present invention relates to an extension used with an automobile key. Two embodiments of the invention are disclosed. One is essentially for domestic automobile keys and the other for foreign automobile keys. The domestic version has apertures to fit over the thumb tabs on the ignition key's insert aperture.

The foreign version mounts the ignition key to the extender by a peg through a hole in the extender. In both embodiments the extender has a leverage handle which when moved causes the ignition key to turn and actuate the engine's starting.

DESCRIPTION OF THE PRIOR ART

In the prior art various types of inventions have been used to assist persons having difficulty holding small objects such as automobile ignition keys. The U.S. Pat. No. 4,910,983 to Robert Taylor discloses one of these inventions. Therein the automobile key extension with a housing grips the key's head and fits over the ignition keyhole's insert thumbs tabs. A protuberance may also be used to guide the key's insertion. The FIG. 6 housing acts to provide a greater turning moment by using the key holder and its slot 52 can engage the thumb tabs. Other references, such as U.S. Pat. No. 4,821,542 to J. Rosenthal, assist the user in positioning a key in a keyhole. Still other provide for anti-theft protection for auto locks (see U.S. Pat. No. 4,426,859 to H. Floyd).

None of the known prior art provides for a simple key extension actuated by pulling the extender which is both inexpensive to construct and adaptable for use on a wide variety of both domestic and foreign automobiles.

SUMMARY OF THE INVENTION

The present invention consists of an extension adapted to be mounted on an automobile's ignition key. Two embodiments are disclosed; one usable with domestic automobiles and the other for foreign automobiles. The domestic version has a cover with two keyhole thumb tab receiving holes serving as ignition tab holders, and a protruding lever handle. The foreign version has a key cover with an extending thumb grip. A snap in peg is inserted in an opening of the cover to hold the key.

It is an object of the present invention to provide an improved extension key holder.

It is a further object of the present invention to provide a key holder extension usable with an automobile's ignition key whether domestic or foreign.

These and other objects and advantages of the present invention will be fully apparent from the following description, when taken in connection with the annexed drawings.

DESCRIPTION OF THE PREFERRED EMBODIMENT

Figure 1:
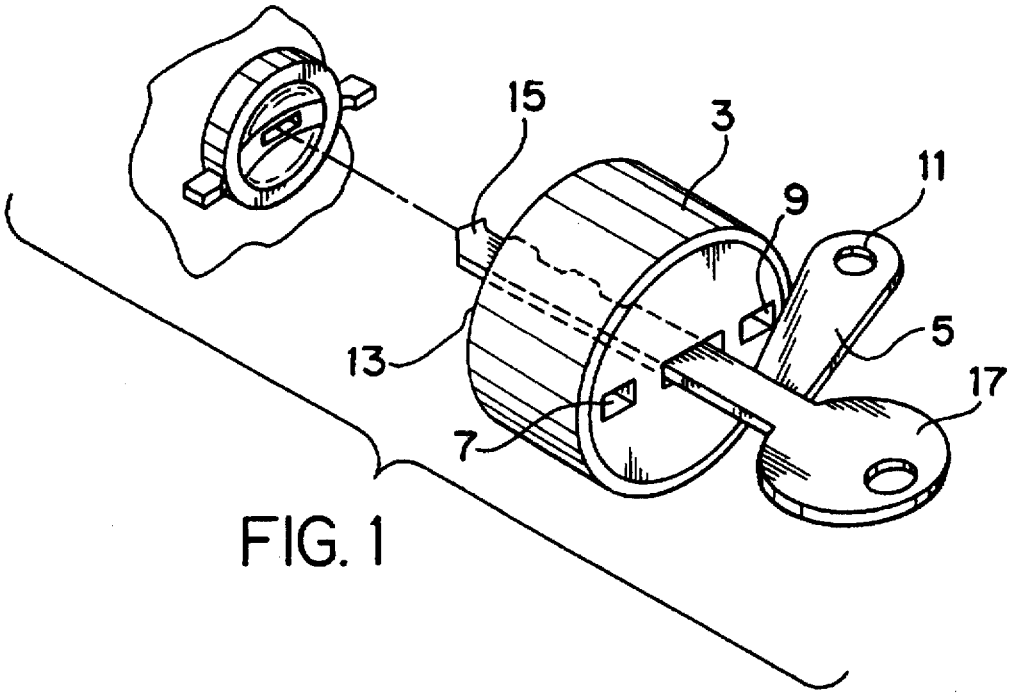
FIG. 1 shows the present invention adapted to be used primarily with domestic automobiles.

Referring now to the drawings in greater detail, FIG. 1 shows the plastic extension cover with its bell-shaped key collar 3 and leverage handle 5. This handle is generally in the same plane as the held key and rigid enough so that it will not bend easily. Two holes, 7 and 9, in the collar fit over the thumb tabs commonly found in domestic ignition keyholes. A hole 11 in the handle permits the extension to be added to a user's key ring. A skirt 13 encircles the collar's base to provide a flexible fit when a key's end 15 is inserted into the automobile's ignition keyhole. The key's head 17 extends from the extension and the key is held to the extension by the friction of its tight fitting plastic cover.

Figure 2:
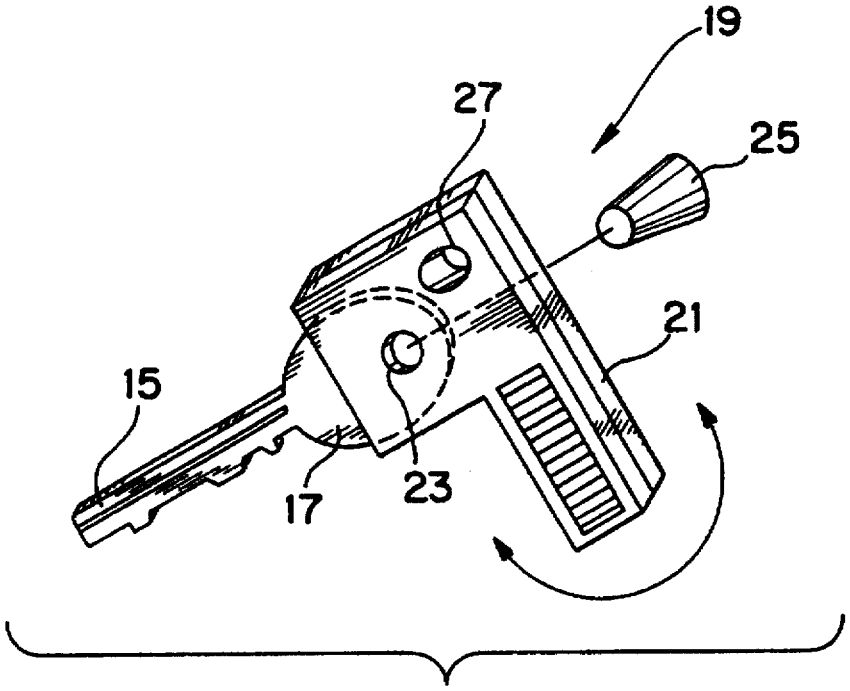
FIG. 2 is a second embodiment of the present invention usable primarily with foreign automobiles.

The FIG. 2 embodiment of my invention 19 fits over the head of a key 17 and has an extending leverage handle 21. Within the extension's cover is a hole 23 adapted to receive a truncated cone shaped peg 25. When the peg is inserted into the cover's hole it passes through a second hole in the held key. When this happens a friction fit acts to retain the key to the extension. Another hole 27 in the extension's cover is used to allow attachment of the key to a key ring.

Both key extension covers are rigid structures which cannot be easily bent and are preferably made of plastic using the plastic injection molding process. In this process softened plastic material is forced under very high pressure into a metal cavity mold made of aluminum or steel which is relatively cool. The mold's cavity inside is comprised of two or more halves and is the same desired shape as the product to be formed (in this case the ignition key extension's cover). High pressure hydraulics are used to keep the mold components together during the actual injection phase of the molding process. When cooled and hardened, the hydraulics, holding the multiple component cavity together, are released and the halves of the mold separated. The formed product is a solid plastic item which is removed. This process is highly automated and is capable of producing extremely detailed parts at a very cost effective price.

In use, if the ignition keyhole is located on the automobile's steering column, the inserted key extension is pulled towards a user to turn the key and start the engine. Should the ignition keyhole be located on the automobile's dashboard, the extension is also pulled while a slight twist is being imparted in order to turn the in-place key within the keyhole.

It should be clear that while the two embodiments shown have been labeled as applying to domestic or foreign automobiles, it is not the manufacturing source of the automobile which controls their use. The controlling use is the arrangement of the ignition's keyhole setup rather than the automobile's nameplate.

Once fitted over an ignition's key, the extension handle is pulled towards a user to actuate the key's turning. Its molded construction allowed this to happen without requiring the normal turning motion. A turning motion is difficult for many persons having physical impairments, such as arthritis sufferers who experience pain when holding or manipulating small objects. In this manner I have alleviated one of the common problems suffered by many.

Clearly, the principles set forth herein are not limited to ignition keys. The present invention could also be used with other types of keys with only minor modifications.

Although the Ignition Key Extension and the method of using and constructing the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A key extension adapted to be used with an automobile ignition having a keyhole and thumb tabs and an ignition key, comprising a generally cylindrical cover adapted to fit over a portion of the key, said cover having a leverage handle extending from the cover, and three spaced apart openings for receiving the key and the thumb tabs such that the held key can be turned when inserted into an automobile's ignition keyhole by pulling on the handle.

2. The key extension as claimed in claim 1, wherein said cover has a hole adapted to permit a key ring to be inserted therein.

* * * * *